United States Patent [19]

Moss

[11] 4,228,703

[45] Oct. 21, 1980

[54] DEVICE FOR SHARPENING ARROWHEADS

[76] Inventor: Donald C. Moss, Box 55, Bonds Flat Rd., La Grange, Calif. 95329

[21] Appl. No.: 16,939

[22] Filed: Mar. 2, 1979

[51] Int. Cl.[3] ..... B21K 17/00

[52] U.S. Cl. ..... 76/86; 76/82.2; 29/80

[58] Field of Search ..... 76/82, 82.2, 83, 86, 76/88; 29/80; 51/205 WG, 214

[56] References Cited

U.S. PATENT DOCUMENTS

| | | | |
|---|---|---|---|
| 578,440 | 3/1879 | Beaudin | 76/86 |
| 1,622,197 | 3/1927 | Keezer et al. | 76/86 |
| 2,010,141 | 8/1935 | Cronan | 51/205 WG |
| 2,765,681 | 10/1956 | Robbins | 76/86 |
| 3,797,334 | 3/1974 | Sinclair | 51/214 |
| 4,078,455 | 3/1978 | Brody | 51/214 |

FOREIGN PATENT DOCUMENTS

| | | | |
|---|---|---|---|
| 849512 | 9/1928 | France | 51/214 |

*Primary Examiner*—Othell M. Simpson
*Assistant Examiner*—Roscoe V. Parker
*Attorney, Agent, or Firm*—J. L. Bohan

[57] ABSTRACT

An arrowhead sharpening device comprised of two cylindrical, untapered files positioned with their longitudinal axes parallel to one another and their surfaces in contact so that a V-shaped trough is formed between them. Each blade of the broadhead arrow is sharpened by holding the arrow shank and placing the edge of the blade in the V-shaped trough and drawing the arrow toward the user.

1 Claim, 4 Drawing Figures

DEVICE FOR SHARPENING ARROWHEADS

BACKGROUND OF THE INVENTION

This invention relates in general to sharpening devices and more particularly to a sharpening device for sharpening broadhead arrows.

It is highly desirable in archery hunting to provide the broadhead arrows with razor sharp edges. As will be discussed herein below, these sharp qualities will allow for effective penetration of the game so as to decrease the probability of merely wounding the game. Various devices have been used heretofore for the purpose of sharpening the edges of broadhead arrows; however these do not have the ability to produce the unique sharp edges of the present device and do not lend themselves to the ease of use of that of the present design.

An example of the prior art arrowhead sharpening device is that shown in U.S. Pat. No. 3,797,334, issued to Bernard J. Sinclair, on Mar. 19, 1974. This device using a flat file is capable of sharpening only one double edge at a time, whereas the device of the present invention sharpens both bevels of a single edge at one time. Another exampe of a single bevel sharpening device is that shown in U.S. Pat. No. 4,078,455, issued on Mar. 14, 1978, to John F. Brody. Other example of sharpening devices in the prior art are those shown in U.S. Pat. No. 1,622,197, issued on Mar. 22, 1927, to L. M. Keezer, et. al., however this device likewise uses files with flat surfaces having intersecting planes unlike the device of the present invention which is comprised of cylindrical file members; further example is that shown in U.S. Pat. No. 578,440, issued to E. Beaudin, on Mar. 9, 1897. This device shows concave filing surfaces in juxtaposition, which are held firmly in place by setscrews and have limited movement with respect to presenting fresh cutting surfaces, unlike the device of the present invention, which provides for cylindrical cutting members which can be rotated to provide fresh cutting surfaces so as to maximize the sharpening capabilities of the device.

DESCRIPTION OF PREFERRED EMBODIMENTS

Figure 1:
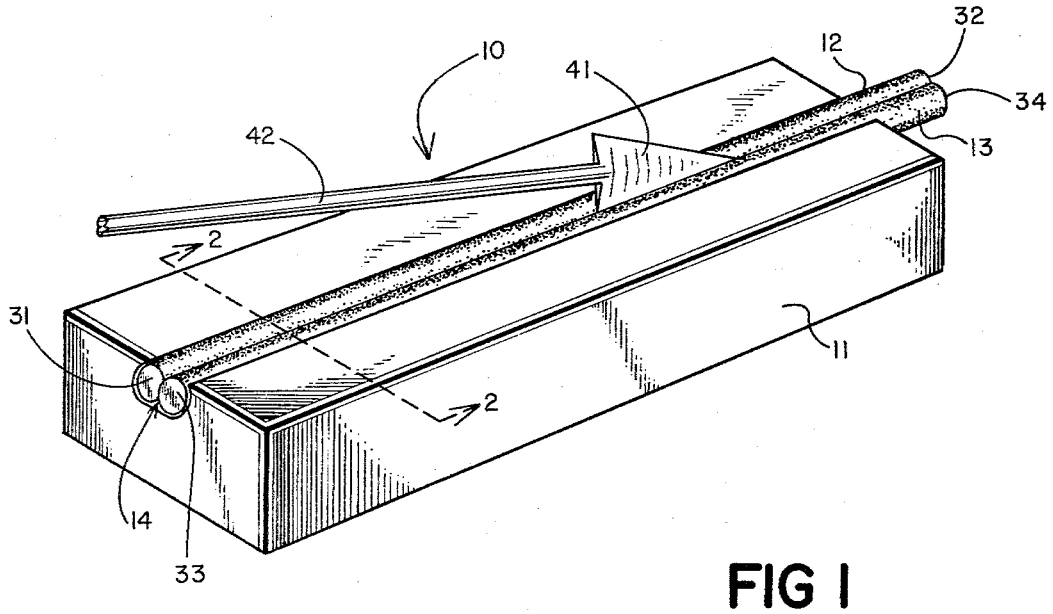
FIG. 1 is a perspective view of the sharpening device of the present invention.

Referring now to FIG. 1, there is shown device 10 of the present invention, comprised of a support block 11 and cylindrical files 12 and 13 contained in recess 14 in the upper surface of said block 11.

Figure 2:
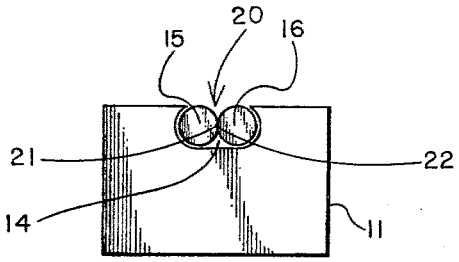
FIG. 2 is a sectional view seen along lines 2—2 of FIG. 1.
Figure 3:
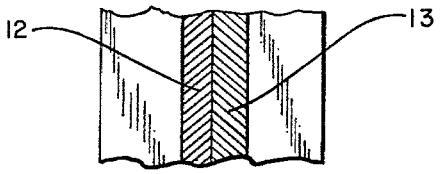
FIG. 3 is a partial top view of the device of the present invention.

The files 12 and 13 are cylindrical having a uniform circular cross section along their entire length and are not tapered at any point. They are placed in recess 14 so that their longitudinal axes 15 and 16, respectively, are parallel along their entire length. As shown in FIG. 2 this parallel relationship places the other surfaces of the two cylindrical files in contact at points 21 and 22 where a perpendicular plane is tangential to both surfaces. This creates recess 20 between the two cylindrical files 12 and 13 suitable for forming the razor sharp edge of the broadhead arrows. The first cylindrical file 12 contains a first end 31 and a second end 32. Likewise, the second cylindrical file 13 has a first end 33 and a second end 34. The cutting ridges of the files may be single cut or double cut with the cuts being diagonal to the axis or centerline of the file. Whether the file is a single cut or a double cut, it is preferable in the device of the present invention that one of the cutting ridges be a primary cutting ridge and that this primary ridge revolves about the cylindrical surface in a direction opposite on one of the files with respect to the other. In other words, for example on file 12 the cutting ridge on the outside surface thereof and defines a clockwise path proceeding from the first end 31 to the second end 32. However cylindrical file 13 has a cutting ridge on the outside surface thereof which proceeds in a counterclockwise path from first end 33 to second end 34. As shown in FIG. 3 this creates a herringbone affect with respect to these primary cutting ridges; and, accordingly, when the arrowhead edge is drawn through the cavity 20, it meets with substantially equal resistance on each side of the beveled edge thereby removing approximately the same amount of metal from each side of the arrowhead as it is drawn along the recess 20 towards the operator. Although the arrowhead may be placed in the recess 20 in either direction, it should be moved in only one direction during the sharpening process, namely, towards the operator.

Figure 4:
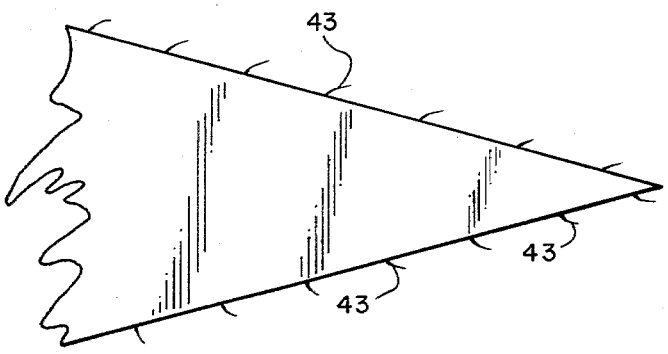
FIG. 4 is a highly magnified view of the most forwardly portion of the tip of the arrowhead.

Pushing the arrowhead away from the operator through the recess 20 makes it difficult to cause the entire flat edge of the individual blade of the arrowhead to be in complete contact along its full length with the file surfaces. This full contact is much more readily attainable by holding the arrowhead 41 in the recess 20 and drawing the shank 42 toward the operator. Drawing the arrowhead in this one direction not only facilitates the use of the device of the present invention but also produces a highly desirable sharpening affect on the individual blades of the arrowhead. In FIG. 4 there is shown a partial view of the very tip of the arrow in a highly magnified form. FIG. 4 is intended to depict a magnified view of only the first ⅛ inch or so of the arrowhead tip. In this magnified view, it will be shown that there are numerous wire edges or burrs 43. By virture of having drawn the arrowhead 41 backwards through the recess 20 these burrs or wire edges will tend to have a forward inclination. These tiny sliverlike metallic members have considerable cutting power and substantially enhance the penetrating and cutting capabilities of the blades of the arrowhead. The blood vessels, organs, and other vital parts of the game animal are slippery and can be pushed out of the way by an arrowhead edge. However the edge of the arrow sharpened by the device of the present invention will contain therein numerous wire edges or slivers 43 which tend to engage such blood vessels or organs and bring the cutting edge of the arrow into full contact therewith. Accordingly, this produces a much higher percentage of clean kills and a substantial reduction in wounded and disabled game.

In the preferred embodiment of the present invention the support block is approximately 1½ inches wide, 1 inch high and 7 inches long. The cylindrical files may be, for example, ¼ inch in diameter and 7 inches long, or slightly longer so as to facilitate removal or rotation. Whether single cut or double cut it is desirable that the primary cut be a right hand or a clockwise cut on one file and an oppositely cut ridge in the other file. This is to produce the herringbone affect as shown in FIG. 3 and as described above. It is preferable that the recess 14 cut into the upper surface of the support block 11 be cut to fairly close tolerances so that cylindrical files 12 and 13 will be held into position by a press fit into the recess. It is preferable in the use of the device of the present invention that after an arrowhead has been drawn through the recess 20 several times the unit should be turned upside down and tapped so as to remove any small iron particles that have accumulated in the recess 20. Once the unit has been used for a period of time it is generally desirable to rotate the cylindrical file 12 in a counterclockwise direction and the file 13 in a clockwise direction so as to free any embedded particles in the recess. The unit is then inverted and tapped so as to remove all of these particles. Moreover this brings into play fresh cutting ridges to enhance the cutting power of the unit. This design allows for the entire 360 degrees of the cutting surface to be utilized by gradual rotation during its use. Accordingly, a highly efficient use of the cutting surfaces created on the file is effected.

The support block 12 may be fabricated of wood, plastic, or other suitable materials. If the material is comparatively soft it may be desirable to line the recess 14 with a material which will resist wear so that a tight fit will continue even after a number of rotations and replacements of the file units within the recess 14.

Although there has been shown and described a particular embodiment of this invention, it will be obvious to those skilled in the art that various changes and modifications may be made therein without departing from the invention.

I claim:

1. A device for sharpening broadhead arrows having a shaft terminating in individual blades having straight beveled edges converging forwardly to a point comprising: a first cylindrical file having a uniform circular cross section along its length, a central longitudinal axis, cutting ridges on the outside surface thereof, and a first end and a second end; a second cylindrical file having a uniform circular cross section along its length, a central longitudinal axis, cutting ridges on the outside surface thereof, and a first end and second end wherein the first cylindrical file has a primary cutting ridge diagonal to the axis of the file and defining a clockwise path proceeding from the first end of the file to to the second end, the second cylindrical file has a primary cutting ridge diagonal to the axis of the file and defining a counterclockwise path proceeding from the first end of the file to the second end; and means for holding said first file and second file in tangential, adjacent contact along a line on their respective outside surfaces with their longitudinal axes parallel thereby forming a longitudinal recess between said file, said means for holding said files being dimensioned so as to allow the files to be rotated about their respective axes so as to bring different portions of their outer surfaces into contact.

* * * * *